US008100737B2

(12) United States Patent
Deal

(10) Patent No.: US 8,100,737 B2
(45) Date of Patent: Jan. 24, 2012

(54) CAMISOLE

(75) Inventor: Beverly Ann Deal, Ventura, CA (US)

(73) Assignee: Ce Soir Lingerie Co., Inc., Ventura, CA (US)

( * ) Notice: Subject to any disclaimer, the term of this patent is extended or adjusted under 35 U.S.C. 154(b) by 141 days.

(21) Appl. No.: 12/455,608

(22) Filed: Jun. 3, 2009

(65) Prior Publication Data

US 2010/0017936 A1 Jan. 28, 2010

Related U.S. Application Data

(63) Continuation-in-part of application No. 29/310,133, filed on Jul. 28, 2008, now Pat. No. Des. 595,932.

(51) Int. Cl.
*A41C 3/00* (2006.01)

(52) U.S. Cl. ..... 450/30; 450/22

(58) Field of Classification Search ..... 450/1, 11, 450/14, 22, 30; 2/73, 78.1–78.4
See application file for complete search history.

(56) References Cited

U.S. PATENT DOCUMENTS

| | | | | |
|---|---|---|---|---|
| 1,344,004 | A * | 6/1920 | Platt | 2/110 |
| 2,009,620 | A * | 7/1935 | Jackson | 450/28 |
| 2,595,139 | A * | 4/1952 | Hart | 450/28 |
| 3,212,503 | A * | 10/1965 | Gorman | 450/32 |
| 4,440,174 | A | 4/1984 | Cordova | |
| 4,798,557 | A * | 1/1989 | Scott | 450/31 |
| D318,749 | S | 8/1991 | Suleiman | |
| 5,045,018 | A | 9/1991 | Castanzo | |
| 5,171,182 | A | 12/1992 | Heinen | |
| 5,643,043 | A | 7/1997 | Pflum | |
| 5,667,422 | A | 9/1997 | Erwin | |
| 5,882,242 | A | 3/1999 | Hardy | |
| 6,162,111 | A * | 12/2000 | Heroff | 450/30 |
| D523,212 | S | 6/2006 | Iourina | |
| 7,083,494 | B2 | 8/2006 | Sandroussi et al. | |
| 7,395,557 | B1 | 7/2008 | Ledyard | |
| 7,409,728 | B2 | 8/2008 | Harry | |
| D577,877 | S | 10/2008 | Saincome-Vawter | |

* cited by examiner

*Primary Examiner* — Gloria Hale
(74) *Attorney, Agent, or Firm* — Arthur Freilich

(57) ABSTRACT

A camisole comprising a tubular garment intended to be worn over a bra having shoulder straps. The camisole includes left and right suspension members, e.g., hooks, for suspending the camisole from the bra straps.

10 Claims, 3 Drawing Sheets

CAMISOLE

RELATED APPLICATIONS

This application is a Continuation-in-part of U.S. Design application 29/310,133 filed on Jul. 28, 2008 now U.S. Pat. No. D595,932 which is by reference, incorporated herein.

FIELD OF THE INVENTION

This invention relates generally to women's clothing and more particularly to camisoles.

BACKGROUND OF THE INVENTION

A "camisole" generally refers to a women's sleeveless undergarment, typically having thin "spaghetti" straps, intended for wearing beneath an outer garment, e.g., a blouse or jacket. A camisole can be worn over a bra or without one. Some camisoles come with a built-in-underwire which eliminates the need for a bra.

SUMMARY OF THE INVENTION

The present invention is directed to a tubular garment intended to be worn as a camisole over a bra having shoulder straps. The garment, or camisole, includes left and right suspension members, e.g., hooks, for suspending the camisole from the bra straps.

A preferred camisole in accordance with the invention is comprised of a decorative, e.g., lace-like, front, or chest, portion having vertically spaced upper and lower margins and laterally spaced left and right margins. A rear, or back, portion extends between the chest portion left and right margins to form a tubular garment. The tubular garment is sufficiently elastic to enable a user to readily pull it over her head. Left and right laterally spaced suspension hooks are secured to the camisole near the chest portion upper margin for easy attachment/detachment to/from the user's bra straps.

DETAILED DESCRIPTION

Figure 1:
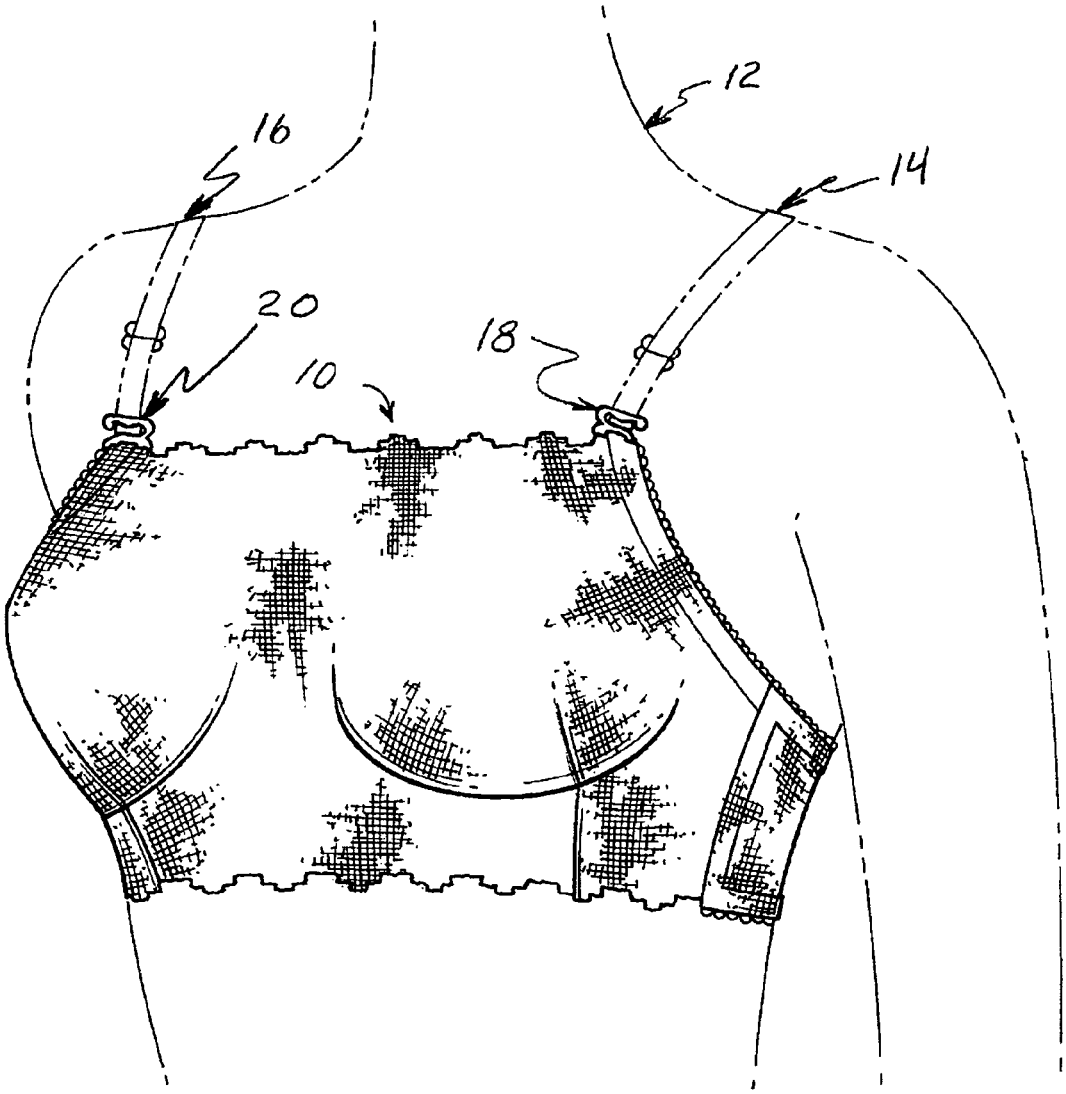
FIG. 1 is a perspective view showing a camisole in accordance with the invention having suspension members for attachment to bra straps worn by a woman, represented by broken lines.

Attention is initially directed to FIG. 1 which illustrates a camisole 10 in accordance with the present invention intended for wearing by a user 12 under an outer garment (not shown) e.g., a blouse or jacket, and over a bra having left and right shoulder straps 14 and 16. The camisole 10 is characterized by the inclusion of left and right suspension members 18 and 20 configured for ready attachment to and detachment from the bra straps 14 and 16.

A preferred embodiment 21 of the invention, as shown in FIGS. 2-7, comprises a tubular garment 22 having a front, or chest, portion 24 and a rear, or back portion 26. More particularly, the chest portion 24 comprises a fabric panel 28 having vertically spaced, e.g., within a range of 6-15 inches, upper and lower margins 30 and 32 and laterally spaced left and right margins 34 and 36. The panel 28 is preferably formed of a decorative soft/flimsy, e.g., lace-like, material 29 which exhibits moderate lateral elasticity. Bindings 37 and 38 are preferably applied to the left and right margins 34 and 36.

The back portion 26 comprises a fabric panel 39 having vertically spaced, e.g., within a range of 2-7 inches, upper and lower margins 40 and 42, and laterally spaced left and right margins 44 and 46. The panel 39 is preferably formed of a soft material exhibiting moderate lateral elasticity.

Figures 2, 3, 4:
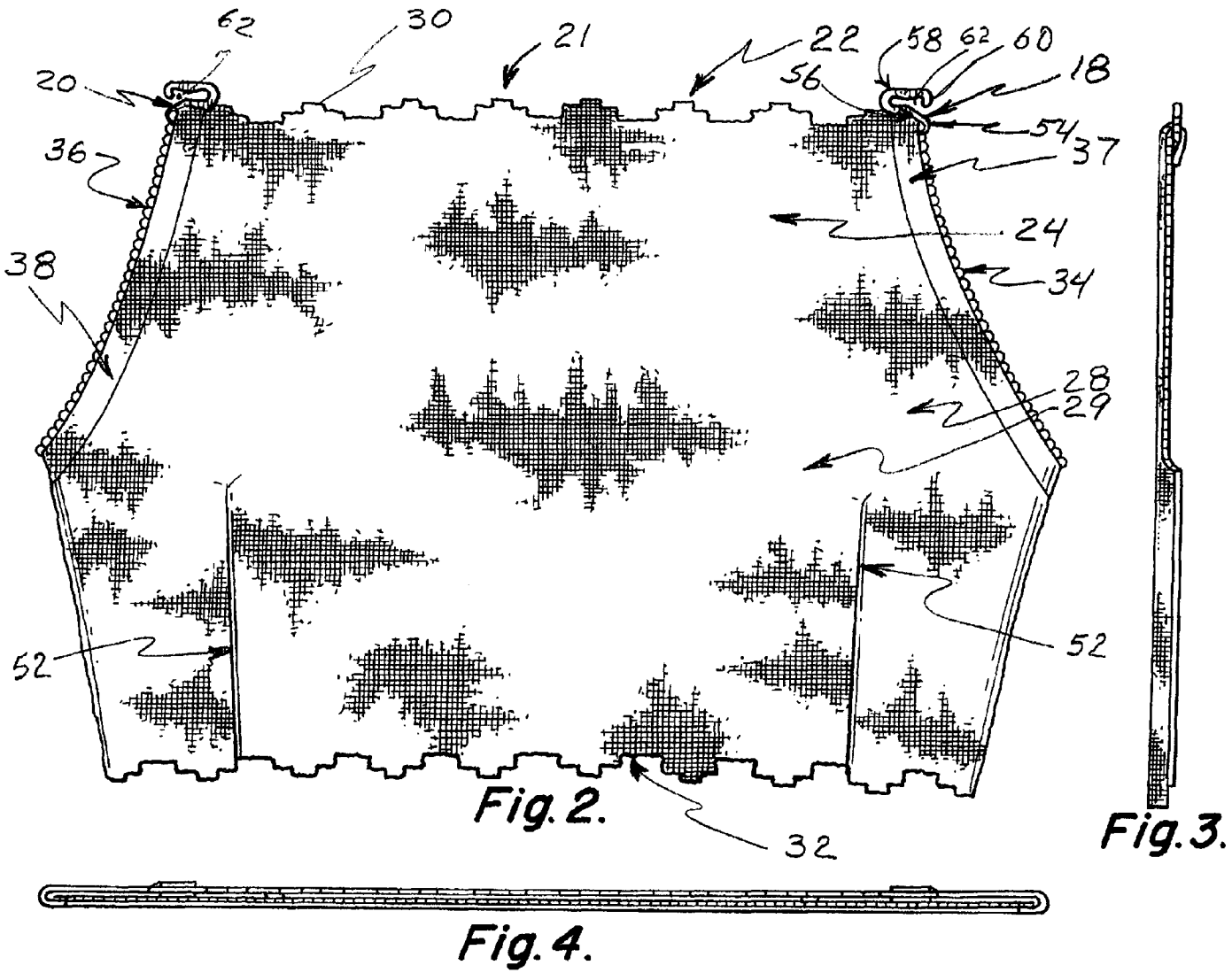
FIG. 2 is a front elevational view of the camisole of FIG. 1.
FIG. 3 is a right side elevational view of the camisole of FIG. 1.
FIG. 4 is a is a top plan view of the camisole of FIG. 1.
Figures 5, 6, 7:
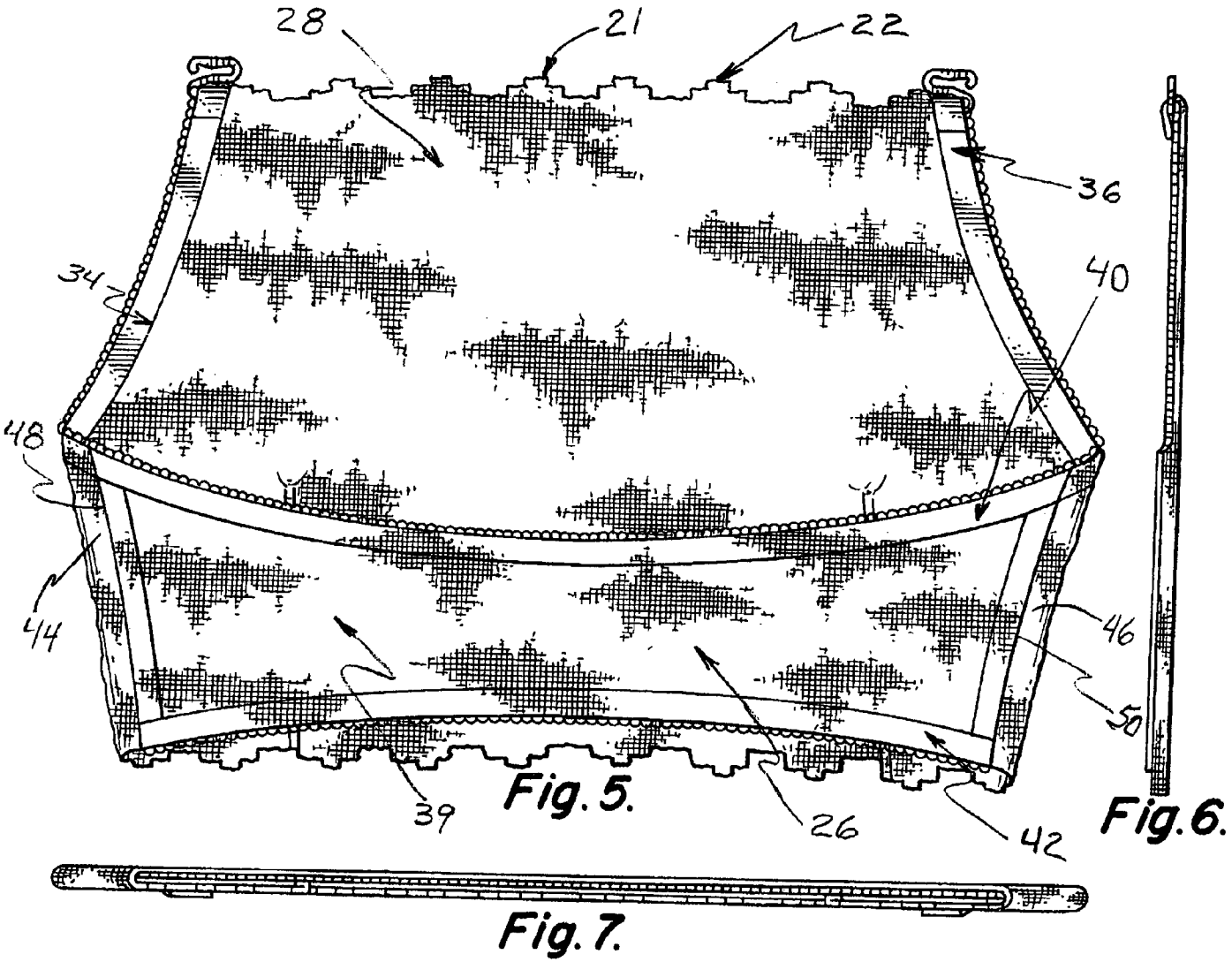
FIG. 5 is a rear elevational view of the camisole of FIG. 1.
FIG. 6 is a left side elevational view of the camisole of FIG. 1.
FIG. 7 is a bottom plan view of the camisole of FIG. 1.

As is best depicted in FIG. 5, the chest portion panel 28 and back portion panel 39 are assembled together to form the tubular garment 22. More particularly the chest panel 28 left margin 34 is sewn along seam 48 to the back panel 39 left margin 44. Similarly, the chest panel 28 right margin 36 is sewn along seam 50 to the back panel 39 right margin 46. FIG. 2 shows the utilization of darts 52 to better fit the panel 28 to the user's bustline.

In accordance with a significant aspect of the invention, a left suspension member 18 is secured to the chest panel 28 along its upper margin 30 and proximate to its left margin 34. A right suspension member 20 is also secured to the chest panel 28 along its upper margin 30 and proximate to its right margin 36. Each of the suspension members 18, 20 is configured for ready attachment to and detachment from a respective bra strap 14, 16. As depicted in the preferred embodiment of FIGS. 2-3, each suspension member includes a lower portion 54 including an eyelet 56 for securing the suspension member to the chest panel upper margin 30. Each suspension member includes a laterally extending hook arm 58 having a depending hook finger 60. The arm 58 and finger 60 bound an open area 62 dimensioned to receive a bra strap as depicted in FIG. 1 with the arm 58 and finger 60 engaging the strap to retain it in the open area 62. The suspension members 18, 20 can be variously configured. Most simply, they will suspend the garment 22 from the bra straps at the junction between the bra straps and the bra cups (not shown). However, the suspension members can alternatively be configured for retention at any user selectable position along the bra straps.

The tubular garment 22 is intended to be worn over a user's bra to provide a comfortable light weight attractive camisole beneath an outer garment. Prior to putting on the outer garment, the user simply pulls the garment 22 over her head outside of bra and then attaches each suspension member to its respective bra strap. The user then puts on her outer garment, e.g., jacket, preferably covering her bra straps but revealing the attractive chest panel 28.

From the foregoing, it should now be appreciated that a lightweight and comfortable garment has been described configured to be suspended from a user's bra straps to conceal the bra and provide an attractive look under an outer garment. Although a single preferred embodiment has been described in detail, it is recognized that alternative embodiments will readily occur to those skilled in the art which are consistent with the spirit of the invention and which fall within the intended scope of the appended claims. For example only, the tubular garment can take many different forms; it can be constructed of a single integral panel or multiple connected panels, and it can include an opening configured for closure by a user operable fastener means such as a zipper or hook and loop fastener. Similarly, the suspension members can take various forms including, for example, the use of hook and loop fasteners.

The invention claimed is:

1. A camisole suitable for wearing over a bra having shoulder straps, said camisole comprising:

a tubular member having a chest portion and a back portion, said tubular member being formed of soft fabric material exhibiting lateral elasticity;

said tubular member chest portion including upper and lower margins spaced by a distance within a range of 6-15 inches;

said tubular member back portion including upper and lower margins spaced by a distance within a range of 2-7 inches;

left and right suspension members secured to said chest portion at spaced locations along said upper margin; and wherein each of said suspension members is configured for ready attachment to and detachment from a bra strap.

2. The camisole of claim 1 wherein said chest portion comprises a fabric panel having laterally spaced left and right margins; and wherein said back portion extends between said chest portion left and right margins.

3. The camisole of claim 2 wherein said chest portion fabric panel includes decorative elastic material.

4. The camisole of claim 2 wherein said back portion comprises a fabric panel including elastic material.

5. The camisole of claim 1 wherein said chest portion is comprised of a decorative fabric panel.

6. The camisole of claim 1 wherein said chest portion includes decorative lace-like fabric.

7. The camisole of claim 1 wherein said back portion includes elastic material.

8. The camisole of claim 1 wherein each of said suspension members comprises a hook.

9. A decorative camisole intended for wearing by a user over a bra having left and right shoulder straps and under an outer garment, said camisole comprising:

a tubular member formed of soft fabric material configured to define a decorative chest portion and a back portion;

said tubular member chest portion including upper and lower margins vertically spaced by a distance within a range of 6-15 inches;

said tubular member back portion including upper and lower margins vertically spaced by a distance within a range of 2-7 inches; and left and right suspension members mounted on said chest portion at laterally spaced locations along said upper margin and wherein said left and right suspension members are configured for ready attachment to and detachment from said bra left and right shoulder straps, respectively.

10. The camisole of claim 9 wherein said tubular member fabric material is characterized by sufficient elasticity to enable a user to readily pull the tubular member over the user's head for placement over said bra.

* * * * *